US006390594B1

(12) United States Patent
Tanno et al.

(10) Patent No.: US 6,390,594 B1
(45) Date of Patent: May 21, 2002

(54) METHOD AND MECHANISM FOR RECOVERING INK-JETTING HEAD AND CAP UTILIZED FOR SUCKING NOZZLES

(75) Inventors: Ryuji Tanno, Hino; Kazuumi Tukinowa, Sayama, both of (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/648,813

(22) Filed: Aug. 25, 2000

(30) Foreign Application Priority Data

Aug. 31, 1999 (JP) ..... 11-245519

(51) Int. Cl.[7] ..... B41J 2/165
(52) U.S. Cl. ..... 347/32; 347/29
(58) Field of Search ..... 347/32, 29, 23, 347/14, 24, 30

(56) References Cited

U.S. PATENT DOCUMENTS 6,309,044 B1 * 10/2001 Gaarder ..... 347/32

FOREIGN PATENT DOCUMENTS

JP 5104731 A * 4/1993 ..... 347/29

* cited by examiner

*Primary Examiner*—N. Le
*Assistant Examiner*—Shih-wen Hsieh
(74) *Attorney, Agent, or Firm*—Bierman, Muserlian and Lucas

(57) ABSTRACT

There are described a method and mechanism for recovering an ink-jetting head and a cap utilized for sucking nozzles. The mechanism includes a cap to cover at least a nozzle hole of the ink-jetting head, a cap movement mechanism to move the cap relative to a nozzle plate on which the nozzle hole is equipped, a depressurizing device and a controller to control the cap movement mechanism, so that the cap moves to a first position at which the cap air-tightly seals a region of the nozzle plate, and moves to a second position at which the cap contacts the nozzle plate to generate a gap between a lip portion of the cap and the nozzle plate, wherein the depressurizing device operates to depressurize a space covered by the cap, when the cap is positioned at the first position, and the depressurizing device operates, when the cap is positioned at the second position.

16 Claims, 5 Drawing Sheets

FIG. 3 ( a )
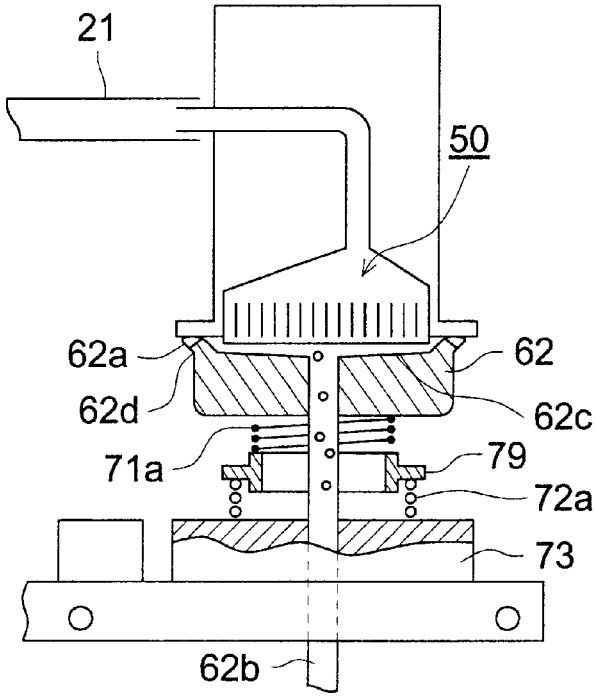
FIG. 3 ( b )
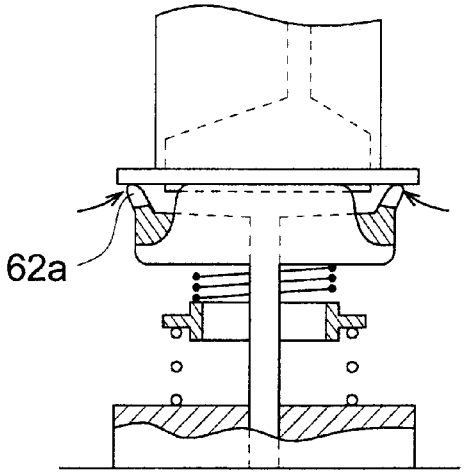

FIG. 4
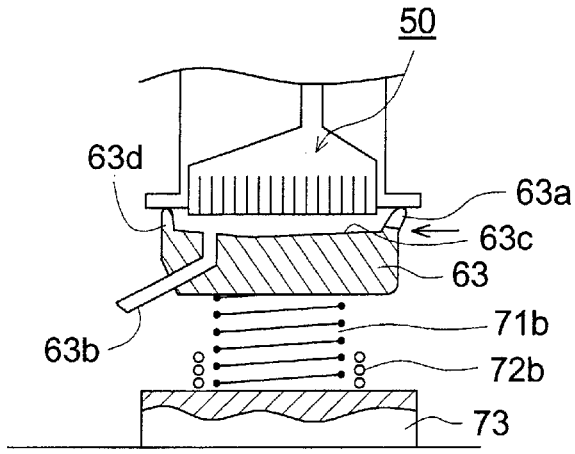
FIG. 5 ( a )
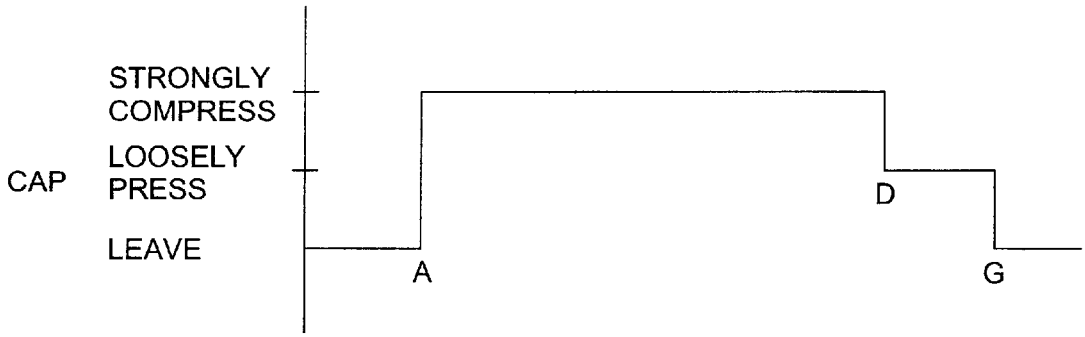
FIG. 5 ( b )
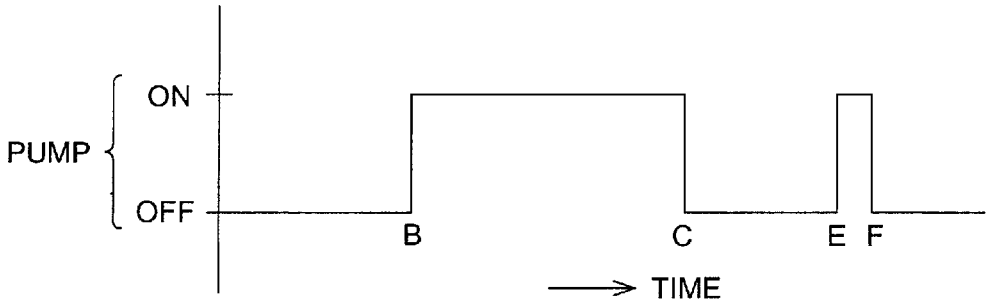

METHOD AND MECHANISM FOR RECOVERING INK-JETTING HEAD AND CAP UTILIZED FOR SUCKING NOZZLES

BACKGROUND OF THE INVENTION

The present invention relates to a method and mechanism for recovering an ink-jetting head and a cap utilized for sucking nozzles.

To recover the ink-jetting head, there have been proposed the following technologies, as a method for discharging air bubbles and dusts remained in an ink-jetting head.

(The First Technology)

Head nozzle holes of an ink-jetting head emit ink-particles directly sticking on a recording sheet. A lip portion of the cap, utilized for sucking nozzles, covers the surface equipped with the head nozzle holes or its peripheral surface. Then, air bubbles and dusts are discharged from the head nozzle holes by depressurizing the air in the space covered with the lip portion, and thereby, the ink-jetting, head is recovered. The electro-magnetic leak valve is equipped in midway of a pipeline between the cap and the pump to absorb the air for the depressurizing operation.

(The Second Technology)

In the ink-jetting head, which emits ink-particles directly sticking on a recording sheet, the cap, utilized for sucking nozzles, always and air-tightly covers the surface equipped with head nozzle holes, from which ink-particles are emitted, or its peripheral surface to discharge air bubbles and dusts from the head nozzle holes by depressurizing the air at the surface equipped with head nozzle holes or its peripheral surface. The electro-magnetic leak valve, employed for the air depressurizing operation, is provided in the cap.

(The Third Technology)

The water repellent finishing is applied for the inner surface of the cap utilized for sucking nozzles, and/or the ink-absorbing member is provided in the cap.

When employing the first technology and/or the second technology, however, it is difficult to clean up ink-particles and dusts stuck on the nozzle plate of the ink-jetting head. Further, it is the problem in the third technology that the ink-absorbing member is necessary to be provided and the effect of the water repellent finishing for the cap is liable to deteriorate in a long time usage.

SUMMARY OF THE INVENTION

To overcome the abovementioned drawbacks in conventional mechanisms for recovering the ink-jetting head and conventional caps utilized for sucking nozzles, it is an object of the present invention to provide a method and a mechanism for recovering an ink-jetting head, which could effectively discharge ink-particles stuck on the surface of nozzle holes and its peripheral surface to recover the ink-jetting head.

Another object of the present invention is to provide a cap utilized for sucking nozzles, which makes it possible to surely discharge air-bubbles, dusts, etc., remaining in the ink-jetting head, and ink-particles stuck on the surface of nozzle holes and its peripheral surface to surely recover the ink-jetting head.

Accordingly, to overcome the cited shortcomings, the abovementioned objects of the present invention can be attained by mechanisms, ink-jet printers and caps described as follow.

(1) A mechanism for recovering an ink-jetting head, comprising: a cap to cover at least a nozzle hole of the ink-jetting head; a cap movement mechanism to move the cap relative to a nozzle plate on which the nozzle hole is equipped; a depressurizing device; and a controller to control the cap movement mechanism, so that the cap moves relative to the nozzle plate to a first position at which the cap air-tightly seals a region of the nozzle plate including at least the nozzle hole, and moves relative to the nozzle plate to a second position at which the cap contacts the nozzle plate to generate a gap between a lip portion of the cap and the nozzle plate, wherein the depressurizing device operates to depressurize a space covered by the cap, when the cap is positioned at the first position, and the depressurizing device operates, when the cap is positioned at the second position.

(2) The mechanism of item 1, wherein the cap movement mechanism moves the cap relative to the nozzle plate to the first position at which the cap covers a region of the nozzle plate including all nozzle holes equipped on the nozzle plate.

(3) The mechanism of item 1, wherein the cap movement mechanism moves the cap relative to the nozzle plate to the first position at which the nozzle plate and the cap air-tightly contact each other without any gaps.

(4) The mechanism of item 1, wherein the cap movement mechanism comprises an urging section, the controller controls the urging section, so that the urging section urges the cap against the nozzle plate with a first urging force to position the cap at the first position, and the urging section urges the cap against the nozzle plate with a second urging force, being smaller than the first urging force, to position the cap at the second position.

(5) The mechanism of item 4, wherein the urging section comprises a first urging member and a second urging member having a urging force greater than that of the first urging member, and the controller controls the first urging member and the second urging member, so that both the first urging member and the second urging member urge the cap against the nozzle plate to position the cap at the first position, and only the first urging member urges the cap against the nozzle plate to position the cap at the second position.

(6) An ink-jet printer, comprising: an ink-jetting head having a nozzle plate equipped with nozzle holes, through which an ink stored in an ink chamber is emitted; a cap to cover at least one of the nozzle holes of the ink-jetting head; a cap movement mechanism to move the cap relative to the nozzle plate; a depressurizing device; and a controller to control the cap movement mechanism, so that the cap moves relative to the nozzle plate to a first position at which the cap air-tightly seals a region of the nozzle plate including at least one of the nozzle holes, and moves relative to the nozzle plate to a second position at which the cap contacts the nozzle plate to generate a gap between a lip portion of the cap and the nozzle plate, wherein the depressurizing device operates to depressurize a space covered by the cap, when the cap is positioned at the first position, and the depressurizing device operates, when the cap is positioned at the second position.

(7) The ink-jet printer of item 6, wherein the cap movement mechanism moves the cap relative to the nozzle plate to the first position at which the cap covers a region of the nozzle plate including all nozzle holes equipped on the nozzle plate.

(8) The ink-jet printer of item 6, wherein the cap movement mechanism moves the cap relative to the nozzle plate to the first position at which the nozzle plate and the cap air-tightly contact each other without any gaps.

(9) The ink-jet printer of item 6, wherein the cap movement mechanism comprises an urging section, the controller controls the urging section, so that the urging section urges the cap against the nozzle plate with a first urging force to position the cap at the first position, and the urging section urges the cap against the nozzle plate with a second urging force, being smaller than the first urging force, to position the cap at the second position.

(10) The ink-jet printer of item 9, wherein the urging section comprises a first urging member and a second urging member having a urging force greater than that of the first urging member, and the controller controls the first urging member and the second urging member, so that both the first urging member and the second urging member urge the cap against the nozzle plate to position the cap at the first position, and only the first urging member urges the cap against the nozzle plate to position the cap at the second position.

(11) The ink-jet printer of item 6, wherein a surface of a part of the cap opposite the nozzle plate is hydrophilic for the ink.

(12) A cap, utilized for covering an ink-jetting head which includes a nozzle plate equipped with a nozzle hole from which ink-particles are emitted, comprising: a base body, moving relative to the ink-jetting head; and a lip portion, formed on a circumferential edge area of the base body, for air-tightly sealing a space between the nozzle plate and the base body by its elastic deformation, when the cap is strongly compressed to the nozzle plate, and having such a shape that at least one of gap is generated between the nozzle plate and the lip portion by its elastic deformation, when the cap is weakly pressed to the nozzle plate.

(13) The cap of item 12, wherein the shape of the lip portion is a wave-shape.

(14) The cap of item 12, wherein the lip portion has such the shape that at least a part of the lip portion is formed in a concave-shape.

(15) The cap of item 12, wherein the lip portion is formed in substantially a rectangular shape, and has such the shape that at least a edge of its long side is formed in a concave-shape.

(16) The cap of item 12, wherein a surface of a part of the cap opposite the nozzle plate is hydrophilic for the ink-particles.

Further, to overcome the abovementioned problems, other methods, mechanisms, ink-jet printers and caps, embodied in the present invention, will be described as follow.

(17) A method for recovering ink-jetting head, characterized in that: in the ink-jetting head recovering method in which a lip portion of the cap utilized for sucking nozzles, covers the surface equipped with head nozzle holes or its peripheral surface of the ink-jetting head, which emits ink-particles directly sticking on a recording sheet, and at least air bubbles or dusts are discharged from the head nozzle holes by depressurizing the space covered with the lip portion to recover the ink-jetting head; an air-tight space is formed between the surface equipped with head nozzle holes or its peripheral surface and the cap by compressing the lip portion of the cap onto the surface equipped with head nozzle holes or its peripheral surface, and the air-tight space is depressurized to discharge at least air bubbles or dusts remaining in the ink-jetting head, and, further, the lip portion is contacted or approached to the surface equipped with head nozzle holes or its peripheral surface to form a gap between the surface equipped with head nozzle holes or its peripheral surface and at least a part of the lip portion, and a space, formed between the surface equipped with head nozzle holes or its peripheral surface and the cap, is depressurized to discharge at least ink-particles stuck on the surface equipped with head nozzle holes or its peripheral surface.

(18) A mechanism for recovering ink-jetting head, characterized in that: in the ink-jetting head recovering mechanism in which a lip portion of the cap utilized for sucking nozzles, covers the surface equipped with head nozzle holes or its peripheral surface of the ink-jetting head, which emits ink-particles directly sticking on a recording sheet, and at least air bubbles or dusts are discharged from the head nozzle holes by depressurizing the space covered with the lip portion to recover the ink-jetting head; the mechanism is provided with a first covering means for air-tightly covering the surface equipped with head nozzle holes or its peripheral surface and the cap utilized for sucking nozzles, by compressing the lip portion of the cap onto the surface equipped with head nozzle holes or its peripheral surface; a second covering means for covering the surface equipped with head nozzle holes or its peripheral surface and the cap utilized for sucking nozzles, by letting the lip portion contact or approach the surface equipped with head nozzle holes or its peripheral surface and by forming a gap between the surface equipped with head nozzle holes or its peripheral surface and at least a part of the lip portion; and a depressurizing means for depressurizing a space surrounded by the surface equipped with head nozzle holes or its peripheral surface and the cap utilized for sucking nozzles by means of the first covering means or the second covering means, wherein at least air bubbles or dusts, remaining in the ink-jetting head, are discharged from the surface equipped with head nozzle holes or its peripheral surface, and, further, at least ink-particles, stuck on at least the surface equipped with head nozzle holes or its peripheral surface, are discharged to recover the ink-jetting head.

(19) A cap utilized for sucking nozzles, characterized in that: in the cap utilized for sucking nozzles, which covers the surface equipped with head nozzle holes or its peripheral surface of the ink-jetting head, so as to discharge at least air bubbles or dusts in the ink-jetting head by depressurizing the surface equipped with head nozzle holes, which emits ink-particles, or its peripheral surface, in order to recover the ink-jetting head; a shape of a lip portion of the cap, utilized for sucking nozzles, is such a shape that the cap air-tightly seals the lip portion of the cap and the surface equipped with head nozzle holes or its peripheral surface with its elastic deformation by strongly compressing the cap to the surface equipped with head nozzle holes or its peripheral surface, and is such a shape that at least one of gap is generated at the lip portion of the cap and the surface equipped with head nozzle holes or its peripheral surface with its elastic deformation by weakly pressing the cap to the surface equipped with head nozzle holes or its peripheral surface.

(20) A cap utilized for sucking nozzles, characterized in that: in the cap utilized for sucking nozzles, which covers the surface equipped with head nozzle holes or its peripheral surface of the ink-jetting head, so as to discharge at least air bubbles or dusts in the ink-jetting head by depressurizing the surface equipped with head nozzle holes or its peripheral surface, which emits ink-particles; a material of cap utilized for sucking nozzles or the surface opposite the ink-jetting head has a hydrophilic property for the ink used.

(21) A cap utilized for sucking nozzles, characterized in that: in the cap utilized for sucking nozzles, which covers the surface equipped with head nozzle holes or its peripheral surface of the ink-jetting head, so as to discharge at least air bubbles or dusts in the ink-jetting head by depressurizing the surface equipped with head nozzle holes or its peripheral surface, which emits ink-particles; a shape of a lip portion of the cap, utilized for sucking nozzles, is such a shape that the cap air-tightly seals the lip portion of the cap and the surface equipped with head nozzle holes or its peripheral surface with its elastic deformation by compressing the cap to the surface equipped with head nozzle holes or its peripheral surface, and is such a shape that at least one of gap is generated at the lip portion of the cap and the surface equipped with head nozzle holes or its peripheral surface with its elastic deformation by pressing the cap to the surface equipped with head nozzle holes or its peripheral surface, and a material of cap utilized for sucking nozzles or the surface opposite the ink-jetting head has a hydrophilic property for the ink used.

BRIEF DESCRIPTION OF THE DRAWINGS

Other objects and advantages of the present invention will become apparent upon reading the following detailed description and upon reference to the drawings in which:

FIG. 3(*a*) shows a view of the head recovering mechanism, illustrating such a state that the space between the ink-jetting head and the cap is air-tightly sealed, while FIG. 3(*b*) shows a view of the head recovering mechanism, illustrating such a state that the ink-jetting head is loosely covered with the cap having gaps between them;

FIG. 4 show illustrative views of other main structures of the head recovering mechanism;

FIG. 5(*a*) and FIG. 5(*b*)show timing charts of the head recovering mechanism.

DETAILED DESCRIPTION OF THE PREFERRED EMBODIMENT

Figure 1:
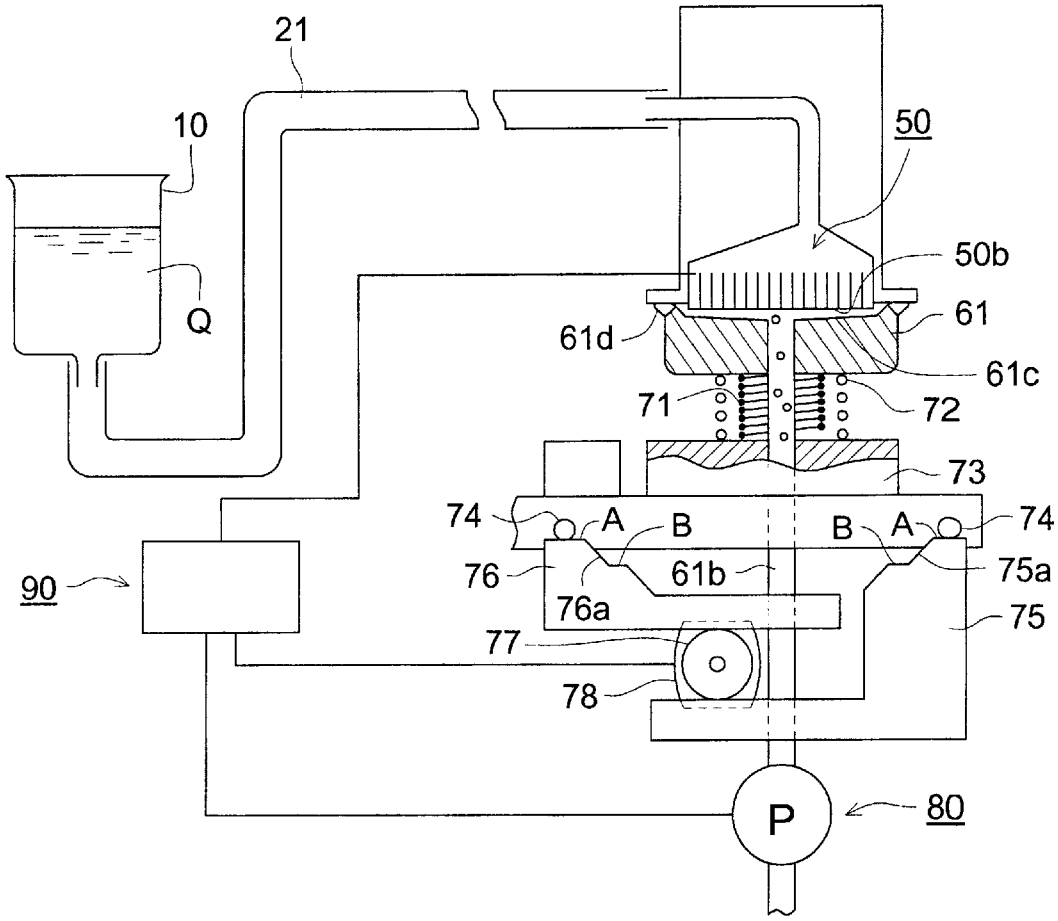
FIG. 1(*a*) shows an illustrative view of the head recovering mechanism, while FIG. 1(*b*)shows a plan view of a nozzle plate of the ink-jetting head.
Figure 1:
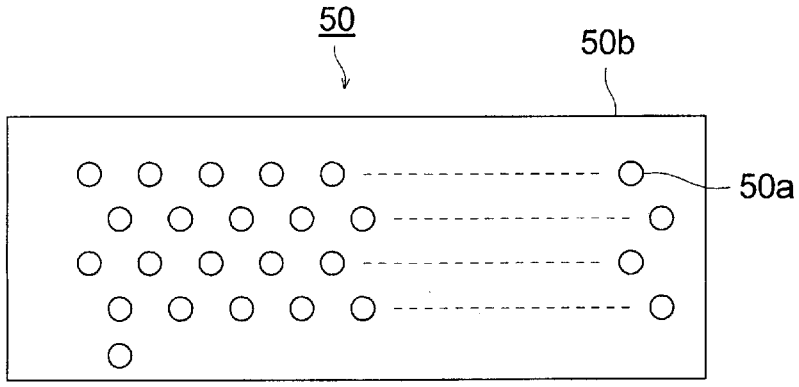

Referring to the drawings, a method and mechanism for recovering an ink-jetting head, embodied in the present invention, and an exemplified embodiment of a cap utilized for sucking nozzles will be detailed in the following.

In the following description, an ink-jet proofing apparatus, which employs an ink-jetting head, is exemplified as an embodiment of the present invention. The ink-jet proofing apparatus is utilized for proofing the printing board by emitting ink-particles directly sticking on a recording sheet. Incidentally, the method and mechanism, embodied in the present invention, are not limited to the ink-jet proofing apparatus, but is applicable for, for instance, ink-jet printers.

The ink-jet proofing apparatus is comprised of the ink-jetting head, which emits ink-particles from ink fed from the ink container based on image information signals, and the mechanism for holding the recording sheet, etc. Further, the ink-jet proofing apparatus also comprises a head recovering mechanism which discharge air bubbles, dusts, alien substances, etc., from the ink-jetting head.

Figure 2:
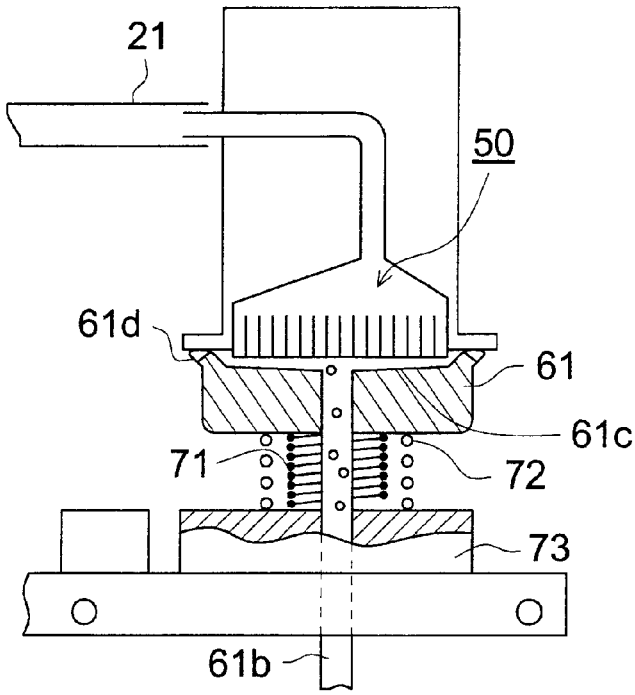
FIG. 2(*a*) and FIG. 2(*b*)show illustrative views of other main structures of the head recovering mechanism.
Figure 2:
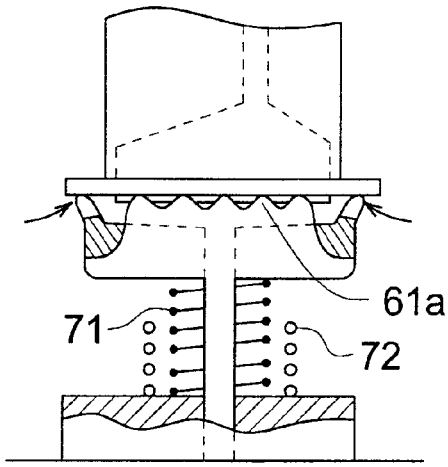
Figure 6:
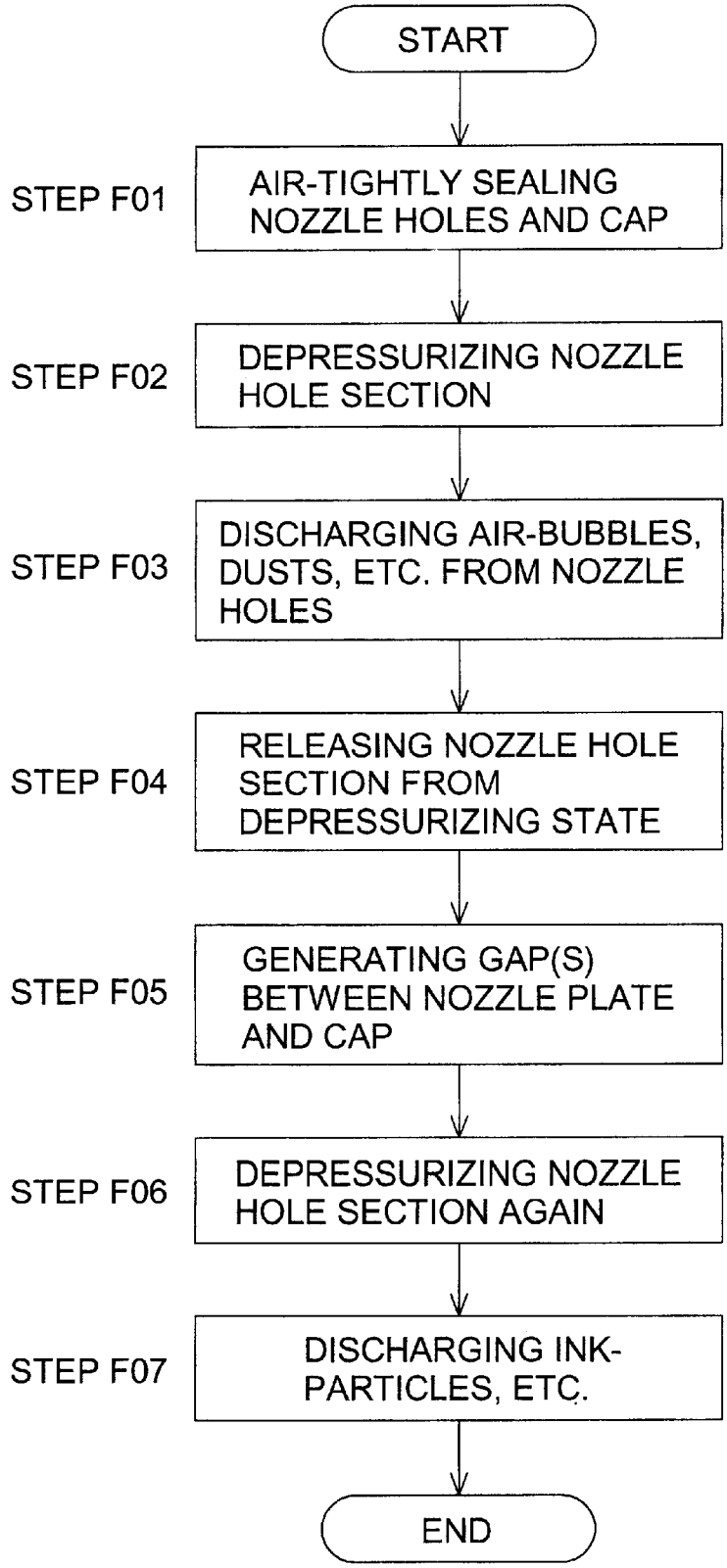
FIG. 6 shows a flowchart of the recovering method of the ink-jetting head.

FIG. 1(*a*) shows an illustrative view of the head recovering mechanism; FIG. 1(*b*)shows a plan view of a nozzle plate of the ink-jetting head; FIG. 2(*a*), FIG. 2(*b*)and FIG. 4 show illustrative views of other main structures of the head recovering mechanisms; FIG. 5(*a*) and FIG. 5(*b*)show timing charts of the head recovering mechanism; and FIG. 6 shows a flowchart of the recovering method of the ink-jetting head.

Initially, referring to FIG. 1(*a*), the configuration of the ink-jet proofing apparatus will be described.

Ink Q stored in ink-container 10 is supplied to ink-jetting head 50 through ink-feeding tube 21. Ink-jetting head 50 emits ink-particles, which directly stick on a recording sheet (not shown in the drawings), in an on-demand mode, to produce the proof.

Next, the head recovering mechanism will be detailed. As shown in FIG. 1(*a*), when motor 78 rotates clockwise to drive pinion gear 77 attached to the axis of motor 78, rack gears 75, 76, both of which are geared with pinion gear 77, move each other in an opposite direction. Cam portions 75*a*, 76*a*, integrally formed with rack gears 75, 76, elevate movable plate 73 by pushing up pins 74 attached to movable plate 73. Incidentally, each of cam portions 75*a*, 76*a* includes cam surface A and cam surface B, which are parallel to movable plate 73. When pins 74 ride on both surfaces A, movable plate 73 compresses both compressive springs 71, 72, while, when pins 74 ride on both surfaces B, movable plate 73 only compresses compressive spring 71. When movable plate 73 is elevated, compressive spring 71, serving as a first urging member, and compressive spring 72, serving as a second urging member, elevate cap 61, so as to cover nozzle plate 50*b* or the peripheral surface of nozzle plate 50*b* with cap 61.

In the above configuration, the first covering means performs that lip portion 61*d* of cap 61, which covers ink-jetting head 50, is air-tightly compressed onto nozzle plate 50*b* or the peripheral surface of nozzle plate 50*b* to form a air-tight space between nozzle plate 50*b* and cap 61.

Incidentally, cap 61 covers at least a region of nozzle holes 50*a* in the surface of nozzle plate 50*b* located opposite cap 61, and it is desirable that cap 61 covers at least all nozzle holes 50*a* in the surface of nozzle plate 50*b* located opposite cap 61.

The second covering means performs that lip portion 61*d* of cap 61 is contacted or approached to nozzle plate 50*b* or the peripheral surface of nozzle plate 50*b* to form a gap between nozzle plate 50*b* and at least a part of lip portion 61*d*.

As shown in FIG. 2(*a*)and FIG. 2(*b*), cap 61 is comprised of lip portion 61*d*, tube 61*b*, bottom surface 61*c*, etc. Lip portion 61*d* further comprises wave-shaped lip portion 61*a*, which contacts the outer circumference of ink-jetting head 50. Bottom surface 61*c* is the bottom surface of cap 61 led through the tube 61*b* for discharging air-bubbles, etc.

Pump 80 is equipped in the midway of tube 61*b*. When Pump 80, serving as a depressurizing means, is activated, the space, formed between cap 61 and nozzle plate 50*b* or peripheral surface of nozzle plate 50*b*, is depressurized.

Next, referring to FIG. 1(*a*)and FIG. 2, the main configuration of the head recovering mechanism will be described. FIG. 2(*a*)shows a view of the head recovering mechanism, illustrating such a state that the space between the ink-jetting head and the cap is air-tightly sealed, while FIG. 2(*b*)shows a view of the head recovering mechanism, illustrating such a state that the ink-jetting head is loosely covered with the cap having gaps between them. When movable plate 73 is elevated to the position, at which pins 74 ride on cam surfaces A of rack gears 75, 76, by activating motor 78, both compressive springs 71 and 72, serving as the first urging member and the second urging member respectively, compress cap 61 to cover ink-jetting head 50. Incidentally, both compressive springs 71 and 72 are mounted between movable plate 73 and cap 61, and the urging force of compressive spring 71 is set at a relatively small value, while the urging force of compressive spring 72 is set at relatively large value. Therefore, when cap 61 is compressed by both compressive springs 71 and 72, lip portion 61*d* is elastically deformed, resulting in the air-tight sealing between the peripheral surface of head nozzle holes 50*a* and lip portion 61*d*. Then, pump 80, shown in FIG. 1(*a*), is activated to depressurize the space between the peripheral surface of head nozzle holes 50*a* and cap 61. Air-bubbles, dusts, etc., remaining in ink-jetting head 50, are discharged from head nozzle holes 50*a* by the depressurizing action mentioned above.

Further, when movable plate 73 is lowered to the position, at which pins 74 ride on cam surfaces B of rack gears 75, 76, by activating motor 78, ink-jetting head 50 is loosely covered with cap 61 having gaps between them, as shown in FIG. 2(*b*), since only the compressive spring 71, having a relatively weak urging force, presses cap 61 to such an extent that lip portion 61*d* is not elastically deformed so much. Then, the air enters into the space from outside through the gaps of wave-shaped lip portion 61*a*, and, for instance, ink-particles stuck on nozzle plate 50*b* and the periphery of nozzle plate 50*b* are absorbed and discharged to tube 61 shown in FIG. 1(*a*). In addition, bottom surface 61*c* of cap 61 is made of silicon rubber and is finished in a rough surface by the sand bursting operation or in a hydrophilic surface by the plasma processing to exhibit a hydrophilic property for the ink employed. Accordingly, it becomes possible to absorb ink-particles stuck on nozzle plate 50*b* and the periphery of nozzle plate 50*b*.

Next, referring to FIG. 3(*a*) and FIG. 3(*b*), another main configuration of the head recovering mechanism will be described. FIG. 3(*a*)shows a view of the head recovering mechanism, illustrating such a state that the space between the ink-jetting head and the cap is air-tightly sealed, while FIG. 3(*b*) shows a view of the head recovering mechanism, illustrating such a state that the ink-jetting head is loosely covered with the cap having gaps between them. In the following, there will be described only the points different from the configuration shown in FIG. 2(*a*)and FIG. 2(*b*).

Compressive springs 71*a* and 72*a*, serving as the first urging member and the second urging member respectively, are inserted in serial between movable plate 73 and cap 62 with ring plate 76 located between compressive springs 71*a* and 72*a*. The urging force of compressive spring 72*a* is greater than that of compressive spring 71*a*. In this configuration, as movable plate 73 is elevated, compressive spring 71*a* is initially deformed to press cap 62, and then, compressive spring 72*a* is successively deformed to compress-cap 62.

Cap 62 is comprised of lip portion 62*d*, tube 62*b*, bottom surface 62*c*, etc. Lip portion 62*d* further comprises tow concave portions 62*a* opposite to ink-jetting head 50. When cap 62 is strongly compressed to ink-jetting head 50, lip portion 62*d* is elastically deformed, resulting in the air-tight sealing between the peripheral surface of head nozzle holes 50*a* and lip portion 62*d*. While, when cap 62 is weakly pressed to ink-jetting head 50, lip portion 62*d* is elastically deformed to such an extent that ink-jetting head 50 is loosely covered with cap 62 having gaps, formed by concave portions 62*a*, between the peripheral surface of head nozzle holes 50*a* and lip portion 62*d*.

Next, referring to FIG. 4, an exemplified configuration of the head recovering mechanism, which is further modified from the configuration shown FIG. 3(*a*) and FIG. 3(*b*), will be described. FIG. 4 shows a view of the head recovering mechanism, illustrating such a state that the ink-jetting head is loosely covered with the cap having gaps between them. In the following, there will be described only the points different from the configuration shown in FIG. 2(*a*) and FIG. 2(*b*).

Compressive springs 71*b* and 72*b*, serving as the first urging member and the second urging member respectively, are inserted in parallel between movable plate 73 and cap 63, and compressive spring 71*b* is located inside compressive spring 72*b*. The urging force of compressive spring 72*b* is greater than that of compressive spring 71*b*. In this configuration, as movable plate 73 is elevated, compressive spring 71*b* is initially deformed to press cap 63, and then, compressive spring 72*b* is successively deformed to compress cap 63.

Cap 63 is comprised of lip portion 63*d*, tube 63*b*, bottom surface 63*c*, etc. Lip portion 63*d* further comprises single concave portion 63*a* opposite to ink-jetting head 50. When cap 63 is strongly compressed to ink-jetting head 50, lip portion 63*d* is elastically deformed, resulting in the air-tight sealing between the peripheral surface of head nozzle holes 50*a* and lip portion 63*d*. While, when cap 63 is weakly pressed to ink-jetting head 50, lip portion 63*d* is elastically deformed to such an extent that ink-jetting head 50 is loosely covered with cap 63 having a gap, formed by concave portion 63*a*, between the peripheral surface of head nozzle holes 50*a* and lip portion 63*d*.

Next, referring to FIG. 5(*a*), FIG. 5(*b*) and FIG. 6, controlling methods for ink-jetting head 50 and pump 80 in the embodiments indicated in FIG. 1(*a*)–FIG. 4, will be detailed in the following. FIG. 5(*a*) shows a timing chart of the compressive force of the cap against the ink-jetting head, while FIG. 5(*b*) shows a timing chart of activation of the pump, plotting the time in the horizontal axis and either ON or OFF state of the pump in the vertical axis. Further, FIG. 6 shows a flowchart of the operating sequence of the cap and the pump. Incidentally, in the following description, the term of "the surface on which nozzle holes reside and its peripheral surface" is referred to as the surface of nozzle holes, and the term of "the region surrounded by the surface of nozzle holes and the cap" is referred to as the nozzle hole section, for simplicity.

Initially, at the time of point A shown in FIG. 5(*a*), the cap is strongly compressed against the ink-jetting head to air-tightly seal the nozzle hole section (step F01). Then, at the time of point B shown in FIG. 5(*b*), the pump is activated (turned ON) to start depressurizing the nozzle hole section (step F02). When the nozzle hole section is sufficiently depressurized, the pump absorbs the ink from nozzle holes of the ink-jetting head through the cap, so as to discharge air-bubbles, dusts, etc., remaining in the ink-jetting head, with the ink (step F03). After maintaining the depressurizing state within the time necessary for discharging air-bubbles, dusts, etc., remaining in the ink-jetting head, the nozzle hole section is released from the depressurizing state by deactivating (turning OFF) the pump at the time of point C shown in FIG. 5(*b*), (step F04). In step F04, the nozzle hole section is filled with ink. At the time of point D shown in FIG. 5(*a*), when the air-pressure in the nozzle hole section reaches near the atmospheric pressure after deactivating the pump, the force for compressing the cap against the ink-jetting head is weakened, so as to generate the gap(s) between the surface of nozzle holes and the cap (step F05). In step F05, the nozzle hole section is still filled with ink. At the time of point E shown in FIG. 5(*b*), when the gap(s) is/are generated between the surface of nozzle holes and the cap, the pump is activated (turned ON) again (step F06). Then, the pump discharges the ink, remaining in the cap, by inflowing the air from the gap(s) generated between the surface of nozzle holes and the cap (step F07). Finally, at the time of point F shown in FIG. 5(*b*), the pump is deactivated (turned OFF), and the cap leaves from the ink-jetting head at the time of point G shown in FIG. 5(*a*).

As detailed in the above, according to the head-recovering method and mechanism embodied in the present invention, it becomes possible to recover the ink-jetting head by discharging air-bubbles, dusts, etc., remaining in the ink-jetting head, and by absorbing, for instance, ink-particles stuck on the surface of nozzle holes, since the nozzle hole section can be depressurized in two steps of the air-tightly sealed state and the loosely sealed state with the gap(s). In addition, since it becomes possible to discharge almost all ink-particles stuck on the surface of nozzle holes, conventional cleaning works for the surface of nozzle holes can be omitted, and the electro-magnetic leak valve, which has been conventionally employed for depressurizing the nozzle hole section, can be excluded.

Further, according to the cap utilized for sucking nozzles, embodied in the present invention, it becomes possible to provide a cap, by which air-bubbles, dusts, etc., remaining in the ink-jetting head, can be discharged, and ink-particles stuck on the surface of nozzle holes can be absorbed, so as to recover the ink-jetting head, since the nozzle hole section is depressurized in two steps of the air-tightly sealed state and the loosely sealed state with the gap(s).

Still further, according to the cap utilized for sucking nozzles, embodied in the present invention, since the surface of the cap is finished in the hydrophilic surface, ink-particles stuck on the surface of nozzle holes can easily flow to the surface of the cap, and therefore, ink-particles hardly remain on the surface of nozzle holes. In addition, the conventional ink-absorbing member can be excluded from the cap, resulting in a simple structure without residential dusts, and the hydrophilic property of the cap hardly deteriorates, compared to the water repellent property.

What is claimed is:

1. A mechanism for recovering an ink-jetting head, comprising:

a cap to cover at least a nozzle hole of said ink-jetting head;

a cap movement mechanism to move said cap relative to a nozzle plate on which said nozzle hole is equipped;

a depressurizing device; and a controller to control said cap movement mechanism, so that said cap moves relative to said nozzle plate to a first position at which said cap air-tightly seals a region of said nozzle plate including at least said nozzle hole, and moves relative to said nozzle plate to a second position at which said cap contacts said nozzle plate to generate a gap between a lip portion of said cap and said nozzle plate, wherein said depressurizing device operates to depressurize a space covered by said cap, when said cap is positioned at said first position, and said depressurizing device operates, when said cap is positioned at said second position.

2. The mechanism of claim 1, wherein said cap movement mechanism moves said cap relative to said nozzle plate to said first position at which said cap covers a region of said nozzle plate including all nozzle holes equipped on said nozzle plate.

3. The mechanism of claim 1, wherein said cap movement mechanism moves said cap relative to said nozzle plate to said first position at which said nozzle plate and said cap air-tightly contact each other without any gaps.

4. The mechanism of claim 1, wherein said cap movement mechanism comprises an urging section, said controller controls said urging section, so that said urging section urges said cap against said nozzle plate with a first urging force to position said cap at said first position, and said urging section urges said cap against said nozzle plate with a second urging force, being smaller than said first urging force, to position said cap at said second position.

5. The mechanism of claim 4, wherein said urging section comprises a first urging member and a second urging member having a urging force greater than that of said first urging member, and said controller controls said first urging member and said second urging member, so that both said first urging member and said second urging member urge said cap against said nozzle plate to position said cap at said first position, and only said first urging member urges said cap against said nozzle plate to position said cap at said second position.

6. An ink-jet printer, comprising:

an ink-jetting head having a nozzle plate equipped with nozzle holes, through which an ink stored in an ink chamber is emitted;

a cap to cover at least one of said nozzle holes of said ink-jetting head;

a cap movement mechanism to move said cap relative to said nozzle plate;

a depressurizing device; and a controller to control said cap movement mechanism, so that said cap moves relative to said nozzle plate to a first position at which said cap air-tightly seals a region of said nozzle plate including at least one of said nozzle holes, and moves relative to said nozzle plate to a second position at which said cap contacts said nozzle plate to generate a gap between a lip portion of said cap and said nozzle plate, wherein said depressurizing device operates to depressurize a space covered by said cap, when said cap is positioned at said first position, and said depressurizing device operates, when said cap is positioned at said second position.

7. The ink-jet printer of claim 6, wherein said cap movement mechanism moves said cap relative to said nozzle plate to said first position at which said cap covers a region of said nozzle plate including all nozzle holes equipped on said nozzle plate.

8. The ink-jet printer of claim 6, wherein said cap movement mechanism moves said cap relative to said nozzle plate to said first position at which said nozzle plate and said cap air-tightly contact each other without any gaps.

9. The ink-jet printer of claim 6, wherein said cap movement mechanism comprises an urging section, said controller controls said urging section, so that said urging section urges said cap against said nozzle plate with a first urging force to position said cap at said first position, and said urging section urges said cap against said nozzle plate with a second urging force, being smaller than said first urging force, to position said cap at said second position.

10. The ink-jet printer of claim 9, wherein said urging section comprises a first urging member and a second urging member having a urging force greater than that of said first urging member, and said controller controls said first urging member and said second urging member, so that both said first urging member and said second urging member urge said cap against said nozzle plate to position said cap at said first position, and only said first urging member urges said cap against said nozzle plate to position said cap at said second position.

11. The ink-jet printer of claim 6, wherein a surface of a part of said cap opposite said nozzle plate is hydrophilic for said ink.

12. A cap, utilized for covering an ink-jetting head which includes a nozzle plate equipped with a nozzle hole from which ink-particles are emitted, comprising:

a base body, moving relative to said ink-jetting head; and a lip portion, formed on a circumferential edge area of said base body, for air-tightly sealing a space between said nozzle plate and said base body by its elastic deformation, when said cap is strongly compressed to said nozzle plate, and having such a shape that at least one of gap is generated between said nozzle plate and said lip portion by its elastic deformation, when said cap is weakly pressed to said nozzle plate;

wherein a controller controls a cap movement mechanism, so that said cap moves relative to said nozzle plate to a first position at which said cap air-tightly seals a region of said nozzle plate including at least said nozzle hole, and moves relative to said nozzle plate to a second position at which said cap contacts said nozzle plate to generate a gap between said lip portion of said cap and said nozzle plate, and a depressurizing device operates to depressurize a space covered by said covered by said cap, when said cap is positioned at said first position, and said depressurizing device operates, when said cap is positioned at said second position.

13. The cap of claim 12, wherein said shape of said lip portion is a wave-shape.

14. The cap of claim 12, wherein said lip portion has such said shape that at least a part of said lip portion is formed in a concave-shape.

15. The cap of claim 12, wherein said lip portion is formed in substantially a rectangular shape, and has such said shape that at least a edge of its long side is formed in a concave-shape.

16. The cap of claim 12, wherein a surface of a part of said cap opposite said nozzle plate is hydrophilic for said ink-particles.

* * * * *